US009517362B1

(12) United States Patent
Siegel

(10) Patent No.: US 9,517,362 B1
(45) Date of Patent: Dec. 13, 2016

(54) ASSISTED RESCUE AND PERSONAL EVACUATION SYSTEM

(71) Applicant: Robert A. Siegel, Waterford, WI (US)

(72) Inventor: Robert A. Siegel, Waterford, WI (US)

(73) Assignee: MALLDRY SAFETY & SUPPLY, LLC, Longview, WA (US)

( * ) Notice: Subject to any disclaimer, the term of this patent is extended or adjusted under 35 U.S.C. 154(b) by 309 days.

(21) Appl. No.: 14/480,654

(22) Filed: Sep. 9, 2014

(51) Int. Cl.

| | |
|---|---|
| ***A62B 1/14*** | (2006.01) |
| ***A45F 3/26*** | (2006.01) |
| ***A45F 4/02*** | (2006.01) |
| ***A62B 1/18*** | (2006.01) |
| *A45F 4/00* | (2006.01) |

(52) U.S. Cl.
CPC . *A62B 1/14* (2013.01); *A45F 3/26* (2013.01); *A45F 4/02* (2013.01); *A62B 1/18* (2013.01); *A45F 2004/006* (2013.01)

(58) Field of Classification Search
CPC ..... A45F 3/04; A45F 4/02; A45C 5/14
USPC ..... 224/153, 162
See application file for complete search history.

(56) References Cited

U.S. PATENT DOCUMENTS 2,640,520 A * 6/1953 Miller ..... A45C 3/001 190/106
3,676,882 A * 7/1972 Lindqvist ..... B63C 9/32 441/85
4,713,033 A * 12/1987 Cameron ..... B63C 9/26 206/388
4,714,135 A * 12/1987 Bell ..... A62B 1/06 182/6
4,836,815 A * 6/1989 Spurgeon ..... B63C 9/26 362/202
5,294,029 A * 3/1994 Shimura ..... A45C 5/00 150/108
5,584,736 A * 12/1996 Salvemini ..... B63C 9/26 441/85
6,257,942 B1 * 7/2001 Groover ..... D07B 1/148 441/84
6,659,823 B1 * 12/2003 Mosna ..... B65H 75/362 441/84
6,679,743 B1 * 1/2004 Gerber ..... B63C 9/26 441/80
6,800,007 B2 * 10/2004 Calkin ..... B63C 9/26 441/80
6,880,702 B1 * 4/2005 Colorado ..... A45F 3/02 206/388

(Continued)

*Primary Examiner* — Nathan J Newhouse
*Assistant Examiner* — Lester L Vanterpool
(74) *Attorney, Agent, or Firm* — Donald J. Ersler

(57) ABSTRACT

An assisted-rescue and personal evacuation system preferably includes a deployment bag, an equipment tether, a stop tether, a flexible anchor strap, a descender system, at least two carabiners and a rescue hitch system. The deployment bag includes a bag portion, an end flap, a rope protector and a pair of snap hooks. The equipment tether includes a tether strap and a tether loop. The tether loop is used to retain all of the rescue components. The stop tether preferably includes a stop body, a first stop carabiner and a second stop carabiner. The descender system preferably includes a rescue rope, a descender unit, a rope carabiner and a descender carabiner. The rescue rope is inserted through the descender unit. The rescue hitch system includes a hitch strap, a micro rope grab and a hitch carabiner. A micro haul device provides a 6:1 mechanical advantage for self or assisted rescue.

17 Claims, 19 Drawing Sheets

(56) References Cited

U.S. PATENT DOCUMENTS

| | | | | |
|---|---|---|---|---|
| 7,080,606 | B1 * | 7/2006 | Harrison | B63B 21/04 114/230.2 |
| 7,285,032 | B2 * | 10/2007 | Cha | B63C 9/26 441/81 |
| 7,942,242 | B1 * | 5/2011 | O'Connor | A62B 1/14 182/189 |
| 8,123,027 | B2 * | 2/2012 | Kirkham | A45C 3/00 102/324 |
| 8,162,365 | B2 * | 4/2012 | Escobar | A62B 99/00 294/140 |
| 9,162,737 | B1 * | 10/2015 | Leatherman | A45C 3/10 |
| 2012/0031783 | A1 * | 2/2012 | Fay, III | A62B 1/14 206/223 |
| 2013/0126567 | A1 * | 5/2013 | Antonio | A45C 13/1046 224/257 |

* cited by examiner

ASSISTED RESCUE AND PERSONAL EVACUATION SYSTEM

BACKGROUND OF THE INVENTION

1. Field of the Invention

The present invention relates generally to safety in extended height situations and more specifically to an assisted-rescue and personal evacuation system, which includes a deployment bag and every component tethered to the deployment bag.

2. Discussion of the Prior Art

Patent application no. 2012/0031783 to Fay, III et al discloses a carry and deploy bag system. Patent application no. 2013/0126567 to Antonio discloses a rescue equipment bag.

Accordingly, there is a clearly felt need in the art for an assisted-rescue and personal evacuation system, which includes a deployment bag and every component tethered to the deployment bag; a harness connection for connecting the deployment bag to a harness of a rescuer; a rope protector attached to an outer perimeter of the deployment bag, and a unique deployment bag end flap for creation of a bucket to retain components and release the components when the end flap is unzipped.

SUMMARY OF THE INVENTION

The present invention provides an assisted-rescue and personal evacuation system, includes a deployment bag and every component tethered to the deployment bag. The assisted-rescue and personal evacuation system preferably includes a deployment bag, an equipment tether, a stop tether, a flexible anchor strap, a descender system, at least two carabiners and a rescue hitch system. The deployment bag includes a bag portion, an end flap, a rope protector and a pair of snap hooks. The end flap is attached to the deployment bag with a flap ring. The end flap is preferably removably attached to an end of the deployment bag with two zippers, but other releasable attachment devices may also be used. The flap ring includes a U-shaped cross section. The flap ring is fabricated from a material with memory, such that when the end flap is unzipped, the end flap is forced against an outer perimeter of the deployment bag. The rope protector is preferably removably retained on a side of the bag portion with hook and loop fasteners. The rope protector includes at least two grommets for attachment of two carabiners or snap clips. The pair of snap hooks extend from opposing ends of the deployment bag. A pair of harness tubes are attached to two harness straps of a fall protection full fall protection full body harness. Each harness tube includes a D-ring. The pair of snap hooks are secured to the D-rings of the pair of harness tubes.

The equipment tether includes a tether strap and a tether loop. One end of the tether strap is attached to an inside of the bag portion and the other end is terminated with the tether loop. The tether loop is used to retain all of the components inside the deployment bag. The stop tether preferably includes a stop body, a first stop carabiner and a second stop carabiner. The stop body includes a retractable line, a loop end and a reel end. The loop end retains the first stop carabiner. The retractable line is retained in the stop body. The reel end retains the second stop carabiner. The second stop carabiner is attached to the tether loop.

The flexible anchor strap includes an anchor carabiner. The anchor carabiner is attached to one end of the flexible anchor strap and clipped on to the tether loop. The descender system preferably includes a rescue rope, a descender unit, a rope carabiner and a descender carabiner. The descender unit is preferably an item purchased from ISC of Wales, Great Britian, but other devices could also be used. One end of the rescue rope is attached to an inside of the deployment bag, and the other end of the rescue rope is inserted through the descender unit. The rope carabiner is secured to the other end of the rescue rope. The descender carabiner is retained in a carabiner opening in the descender unit. The at least two carabiners are clipped on to the tether loop. At least two pulleys are preferably retained on the at least two carabiners. The rescue hitch system preferably includes a hitch strap, a micro rope grab and a hitch carabiner. The micro rope grabber and the hitch strap are retained on the hitch carabiner and the hitch carabiner is clipped on to the tether loop. The micro rope grab includes a grabber tether loop.

A micro haul device provides a 6:1 mechanical advantage for self or assisted rescue. However, other mechanical advantage ratios may also be used. The micro haul device includes a pulley system, an upper haul carabiner and a lower haul carabiner. The pulley system includes a lower floating pulley block, an upper pulley block and a power rope. The power rope is looped through the upper and lower pulley blocks. The lower haul carabiner is retained by the lower pulley block and the upper haul carabiner is retained by the upper pulley block. The upper haul carabiner is clipped on to the tether loop.

The assisted-rescue and personal evacuation system is preferably used in the following manner. The deployment is bag is secured adjacent a waist of a user in either a horizontal or vertical orientation. The end flap is unzipped to allow the components in the deployment bag to fall out of the bag. All of the components are tethered, such that they do not fall to the ground, when they fall out of the deployment bag. The first stop carabiner is clipped on to a D-ring of a fall protection full fall protection full body harness. The second stop carabiner is removed from the tether loop and clipped on to the anchor carabiner. The descender carabiner is then clipped on to the flexible anchor strap, adjacent the anchor carbineer. The rope carabiner is removed from the tether loop and clipped on to a victim's lifting ring or lanyard. The second stop carabiner is removed from the anchor carabiner and attached to the hitch strap. The hitch carabiner is then removed from the hitch strap. The hitch strap is tied around the victim lanyard to form a hitch. The rope carabiner is attached to the hitch strap and the second stop carabiner is removed from the hitch strap.

Next, the second stop carabiner is clipped on to the grabber tether loop extending from the micro rope grab. The hitch carabiner is removed from the micro rope grab and retained on the tether loop. The micro rope grab is attached to the rescue rope. The second stop carabiner is removed from the micro rope grab and attached to one of the grommets on the rope protector. The rope protector is placed over a structural edge that the rescue rope will engage. The rope protector prevents damage to the rescue rope from the structural edge. The first stop carabiner is removed from the tether loop and the retractable line of the stop body is wrapped around a structural anchor and attached to the second grommet on the rope protector.

The micro haul device is preferably deployed in the following manner. The lower haul carabiner is clipped into a bore in the micro rope grab. The upper haul carabiner is removed from the tether loop and clipped on to the anchor carabiner. The victim may now be raised with the micro haul device, by pulling the power rope. The micro haul device provides a 6:1 mechanical advantage for self rescue or assisted rescue. Slack in the rescue rope should be taken-up with the descender unit. The victim's lanyard includes a snap hook. The snap hook is disconnected from a structural support and clipped on to the rope carabiner. The micro rope grab is now removed from the rescue rope. The upper haul carabiner is removed from the flexible anchor strap and clipped back on to the tether loop. The lower haul carabiner is then removed from the bore in the micro rope grab. The hitch carabiner may be used to add another degree of radius, thus increasing the rescuer's control during the lowering operation. The hitch carabiner is removed from the tether loop. The hitch carabiner is clipped around the rescue rope and the flexible anchor strap, adjacent the descender carablineer. The victim may now be lowered to the ground utilizing the descender unit.

Accordingly, it is an object of the present invention to provide an assisted-rescue and personal evacuation system, which includes a deployment bag and every component tethered to the deployment bag.

It is further object of the present invention to provide an assisted-rescue and personal evacuation system, which includes a harness connection for connecting the deployment bag to a harness of a rescuer.

It is another object of the present invention to provide an assisted-rescue and personal evacuation system, which includes a rope protector attached to an outer perimeter of the deployment bag.

Finally, it is another object of the present invention to provide an assisted-rescue and personal evacuation system, which includes a unique deployment bag end flap for creation of a bucket to retain components and release the components when the end flap is unzipped.

DETAILED DESCRIPTION OF THE PREFERRED EMBODIMENTS

Figure 1:
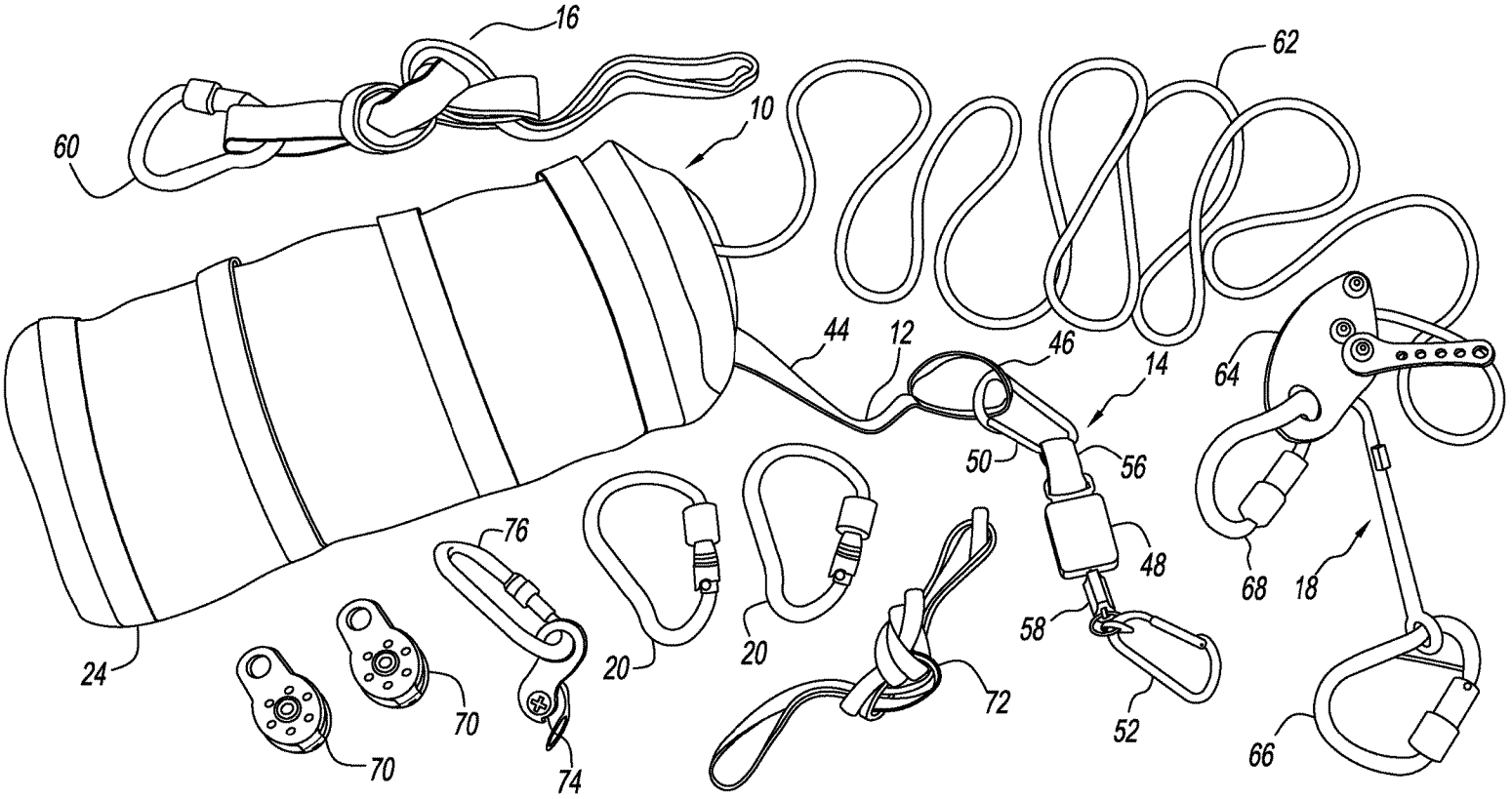
FIG. 1 is an exploded perspective view of an assisted-rescue and personal evacuation system in accordance with the present invention.
Figure 2:
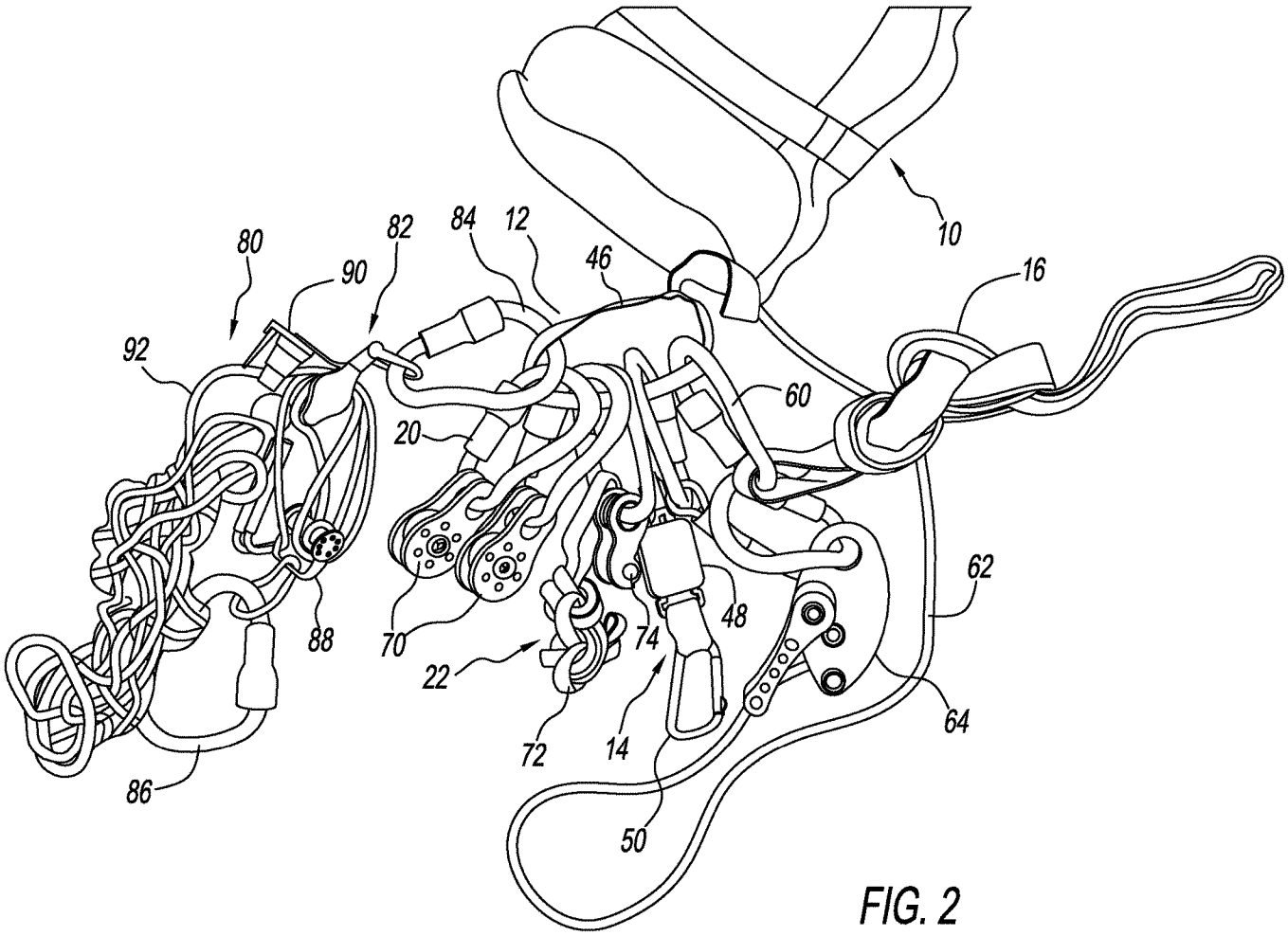
FIG. 2 is a perspective view of an assisted-rescue and personal evacuation system with all the components retained on a tether loop in accordance with the present invention.
Figure 3:
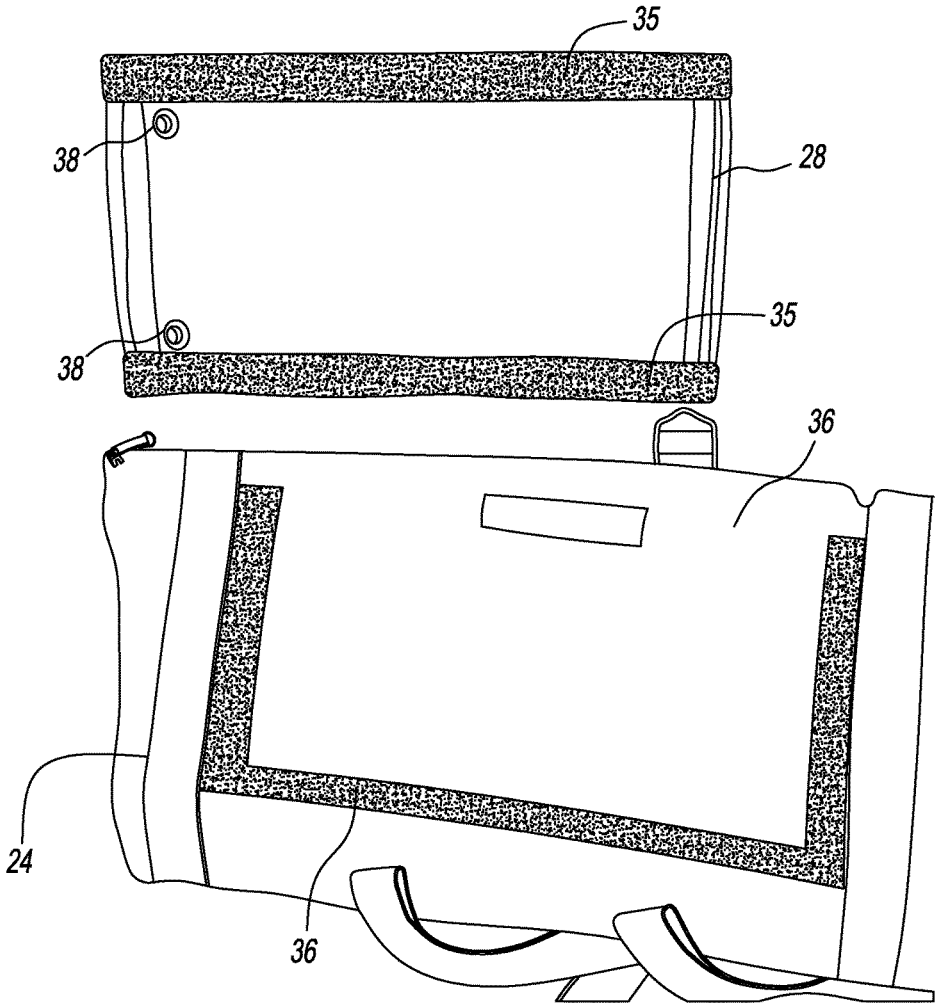
FIG. 3 is an exploded top view of a rope protector removed from an outer perimeter of a deployment bag of an assisted-rescue and personal evacuation system in accordance with the present invention.
Figure 4:
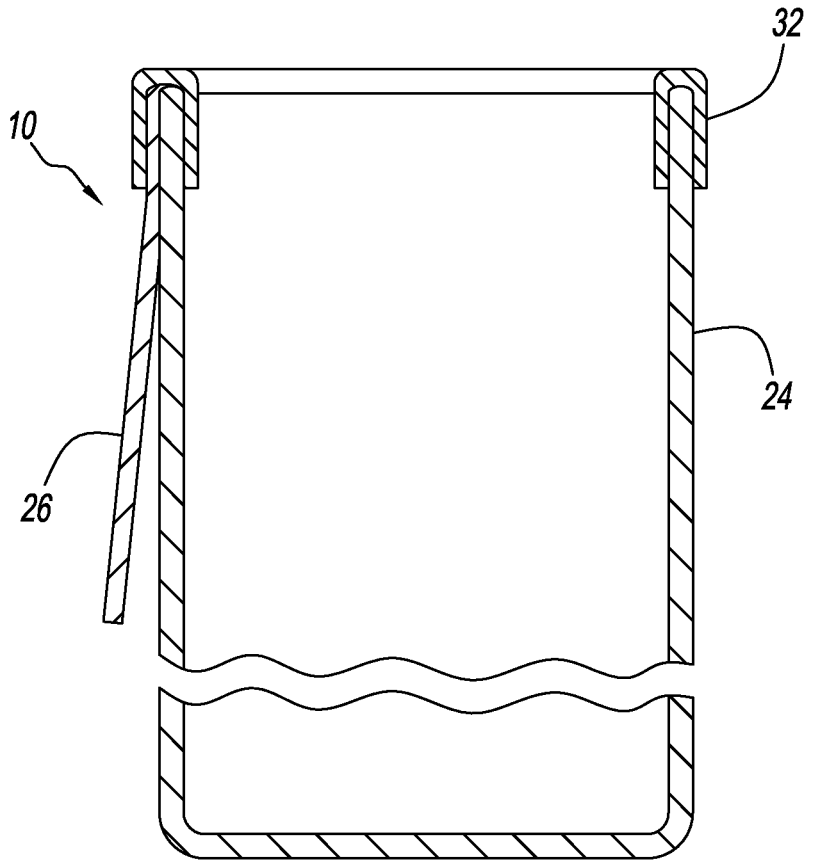
FIG. 4 is a cross sectional view of a portion of a deployment bag illustrating a flap ring attached to an opening of a bag cavity, which forces an unzipped end flap against an outer perimeter of the deployment bag of an assisted-rescue and personal evacuation system in accordance with the present invention.
Figure 5:
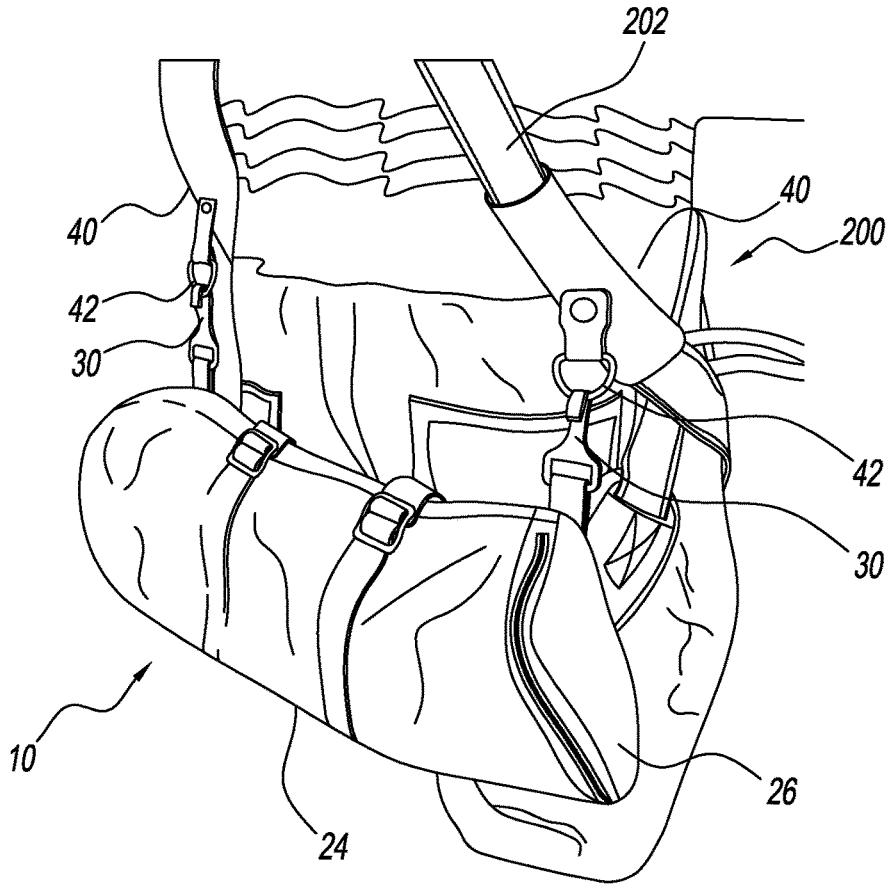
FIG. 5 is a perspective view of a deployment bag in a horizontal orientation of an assisted-rescue and personal evacuation system in accordance with the present invention.

With reference now to the drawings, and particularly to FIG. 1, there is shown an assisted-rescue and personal evacuation system 1. With reference to FIG. 2, the assisted-rescue and personal evacuation system 1 preferably includes a deployment bag 10, an equipment tether 12, a stop tether 14, a flexible anchor strap 16, a descender system 18, at least two carabiners 20 and a rescue hitch system 22. With reference to FIGS. 3-7, the deployment bag 10 includes a bag portion 24, an end flap 26, a rope protector 28 and a pair of snap hooks 30. An inside perimeter (or bag cavity) 25 of the bag portion 24 forms a bucket for retaining the equipment tether 12, the stop tether 14, the flexible anchor strap 16, the descender system 18, the at least two carabiners 20 and the rescue hitch system 22 (rescue components). The end flap 26 is attached to the bag portion 24 with a flap ring 32. The end flap 26 is removably attached to an end of the bag portion 24 with two zippers 34, but other releasable attachment devices may also be used. The flap ring 32 includes a U-shaped cross section. The flap ring 32 is fabricated from a material with memory. Zipping the end flap 26 to an end of the bag portion 24 bends the flap ring 32 away from its memory position, such that when the end flap 26 is unzipped that the end flap 26 is forced against an outer perimeter of the bag portion 24 and the flap ring 32 returns to its memory position. The rope protector 28 is preferably removably retained on a side of the bag portion 24 with hook and loop fasteners 35, 36. The rope protector 28 includes at least two grommets 38 for attachment of two carabiners. The pair of snap hooks 30 extend from opposing ends of the bag portion 24. With reference to FIG. 5, a pair of harness tubes 40 are retained on two harness straps 202 of a fall protection full body harness 200. Each harness tube 40 includes a D-ring 42. The pair of snap hooks 30 are secured to the D-rings 42 of the pair of harness tubes 40.

Figure 8:
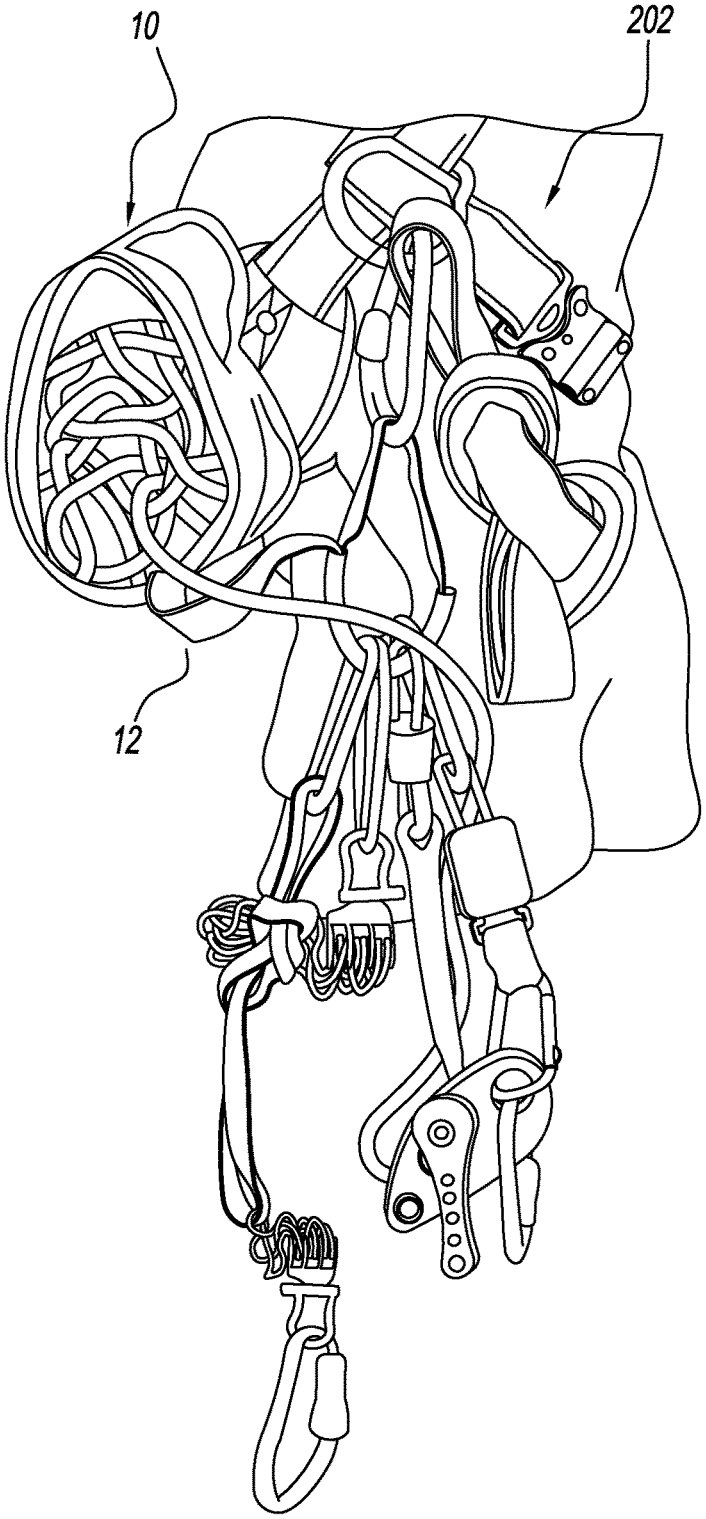
FIG. 8 is a perspective view of components emptied from inside a deployment bag and hanging from the deployment bag of an assisted-rescue and personal evacuation system in accordance with the present invention.
Figure 9:
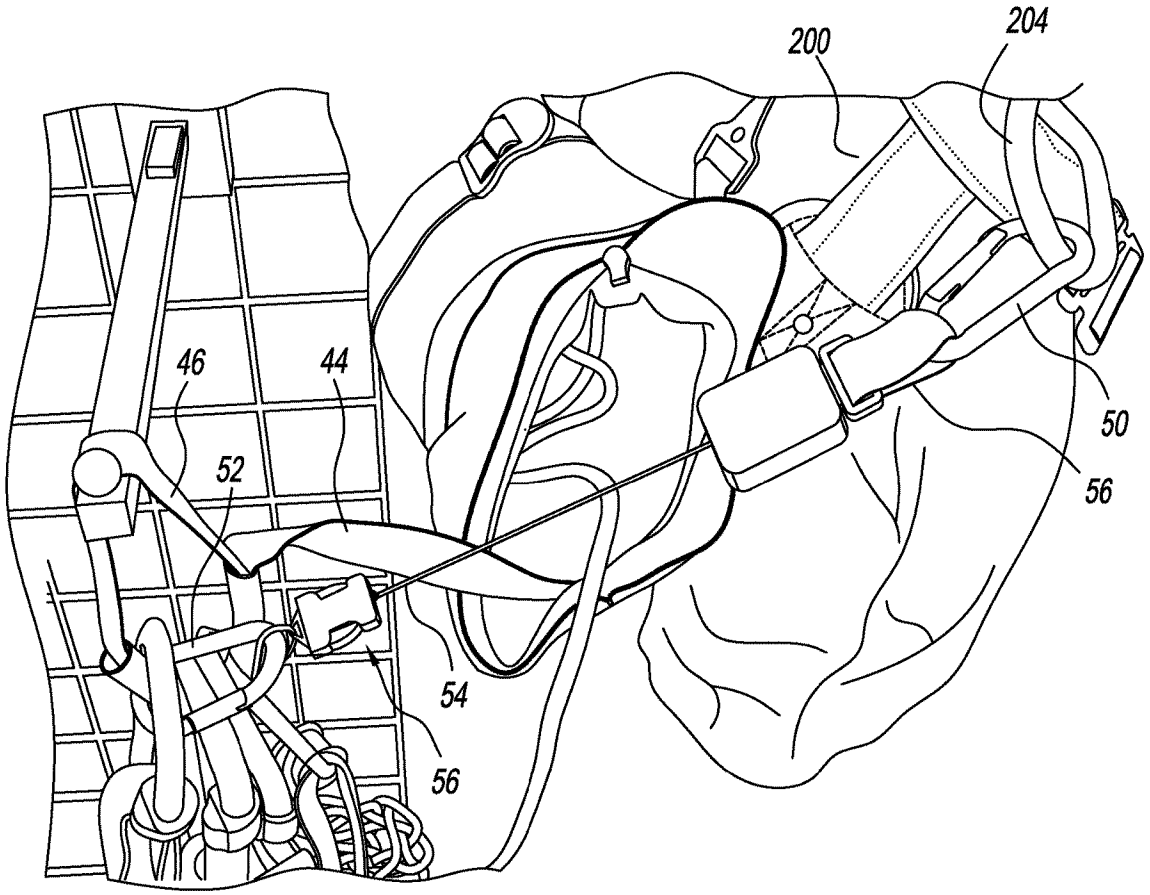
FIG. 9 is a perspective view of a first stop carabiner clipped to a D-ring of a fall protection full body harness of an assisted-rescue and personal evacuation system in accordance with the present invention.

The equipment tether 12 includes a tether strap 44 and a tether loop 46. One end of the tether strap 44 is attached to an inside perimeter 25 of the bag portion 24 and the other end is terminated with the tether loop 46. With reference to FIG. 8, the tether loop 46 is used to retain all of the components, once they are emptied from the bag portion 24. The stop tether preferably includes a stop body 48, a first stop carabiner 50 and a second stop carabiner 52. A carabiner may also be called a snap clip. With reference to FIG. 9, the stop body 48 includes a retractable line 54, a loop end 56 and a reel end 58. The loop end 56 retains the first stop carabiner 50. The retractable line 54 is retained in the stop body 48. The reel end 58 retains the second stop carabiner 52. The second stop carabiner 52 is attached to the tether loop 46.

Figure 14:
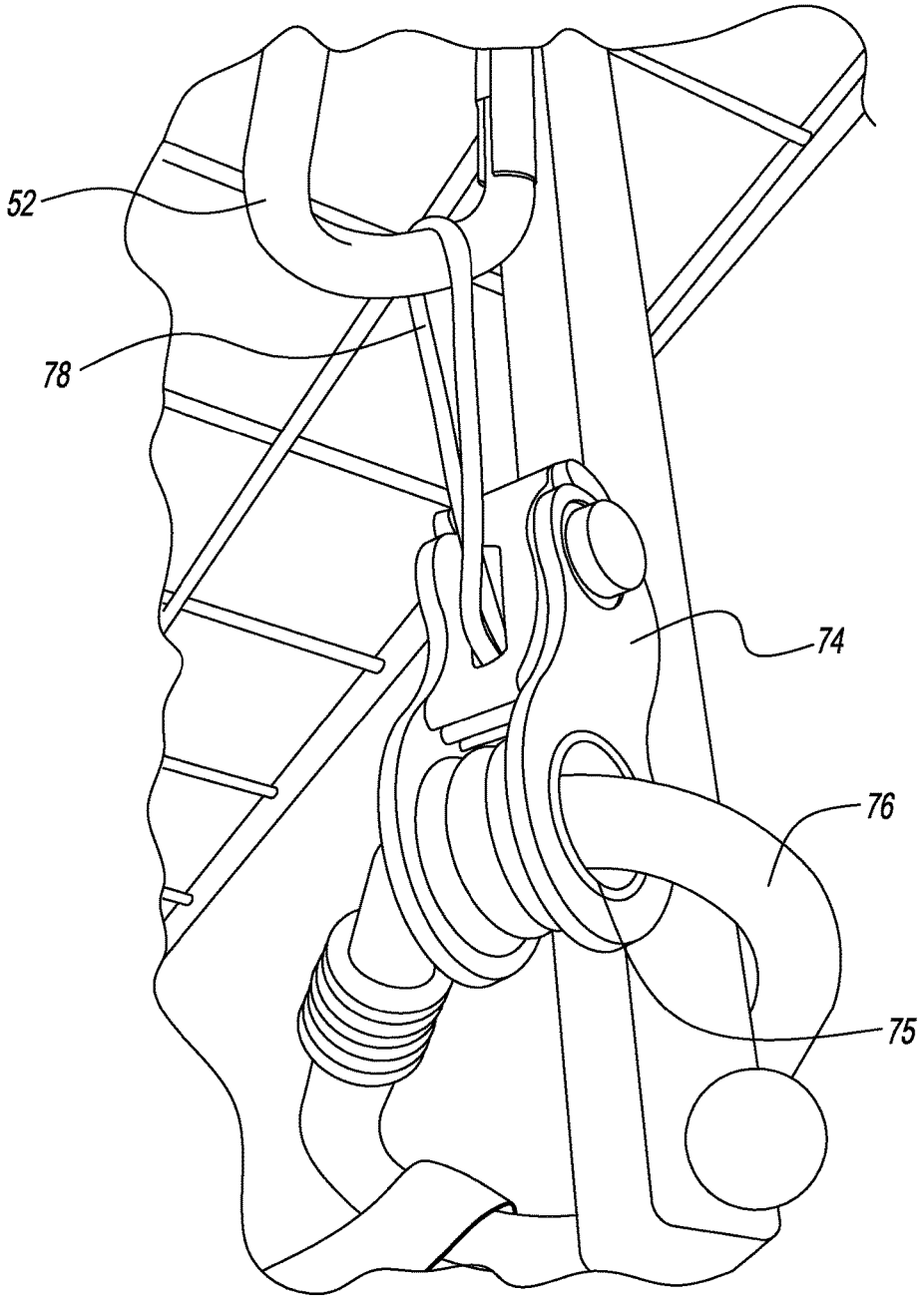
FIG. 14 is a perspective view of a second stop carabiner clipped to a tether loop of a micro rope grab of an assisted-rescue and personal evacuation system in accordance with the present invention.

The flexible anchor strap 16 includes an anchor carabiner 60. The anchor carabiner 60 is attached to one end of the flexible anchor strap 16. The anchor carabiner 60 is clipped on to the tether loop 46. The descender system 18 preferably includes a rescue rope 62, a descender unit 64, a rope carabiner 66 and a descender carabiner 68. The descender unit 64 is preferably an item purchased from ISC, but other devices could also be used. One end of the rescue rope 62 is attached to an inside of the bag portion 24, and the other end of the rescue rope 62 is inserted through the descender unit 64. The rope carabiner 66 is secured to the other end of the rescue rope 62. The descender carabiner 68 is retained in a carabiner opening in the descender unit 64. The at least two carabiners 20 are clipped on to the tether loop 46. At least two pulleys 70 are preferably retained on the at least two carabiners 20. The rescue hitch system 22 preferably includes a hitch strap 72, a micro rope grab 74 and a hitch carabiner 76. The micro rope grab 74 and the hitch strap 72 are retained on the hitch carabiner 76 and the hitch carabiner 76 is clipped on to the tether loop 46. With reference to FIG. 14, the micro rope grab 72 includes a grabber tether loop 78.

Figure 17:
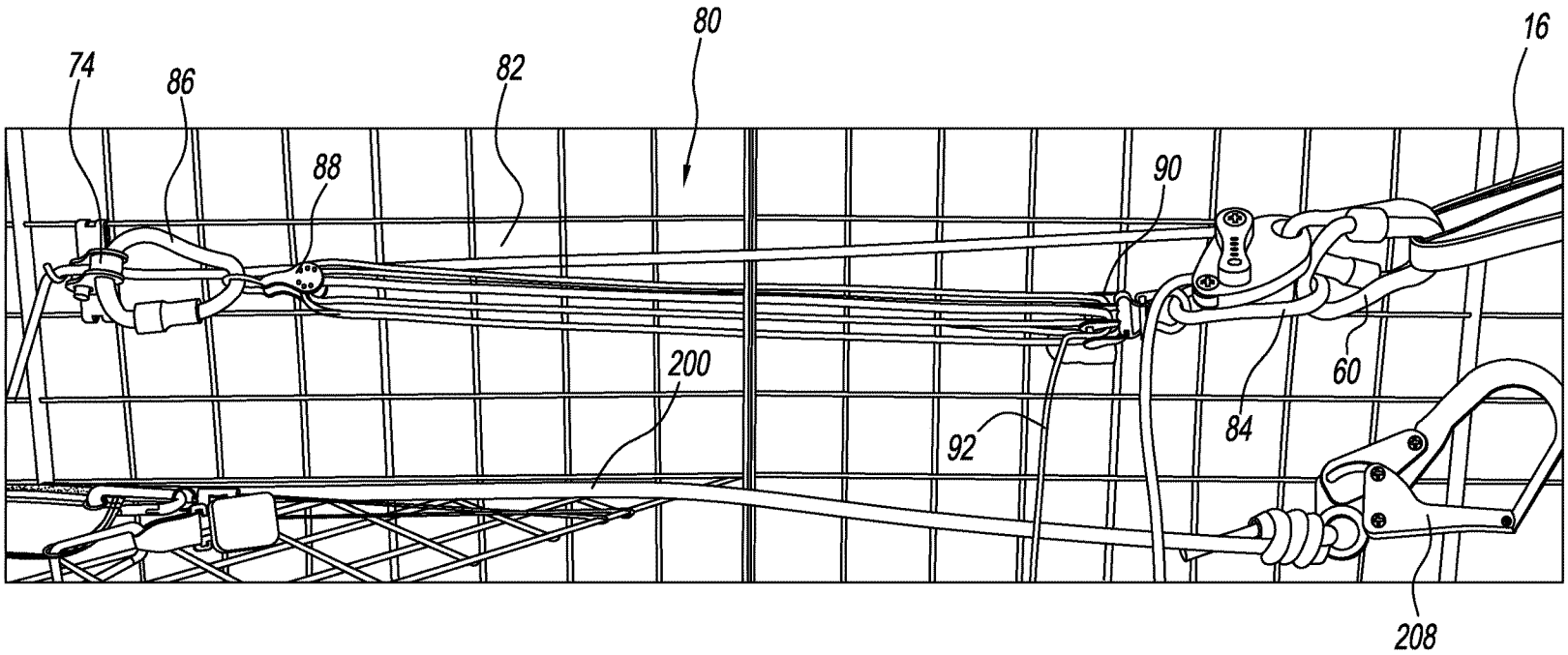
FIG. 17 is a side view of the upper haul carabiner clipped on to the flexible anchor strap of an assisted-rescue and personal evacuation system in accordance with the present invention.

With reference to FIG. 17, a micro haul device 80 preferably provides a 6:1 mechanical advantage for self or assisted rescue, but other mechanical advantage ratios may also be used. The micro haul device 80 includes a pulley system 82, an upper haul carabiner 84 and a lower haul carabiner 86. The pulley system 82 includes a lower floating pulley block 88, an upper pulley block 90 and a power rope 92. The power rope 92 is looped through the upper and lower pulley blocks 88, 90. The lower haul carabiner 86 is retained by the lower floating pulley block 88 and the upper haul carabiner 84 is retained by the upper pulley block 90. The upper haul carabiner 84 is clipped on to the tether loop 46.

Figure 6:
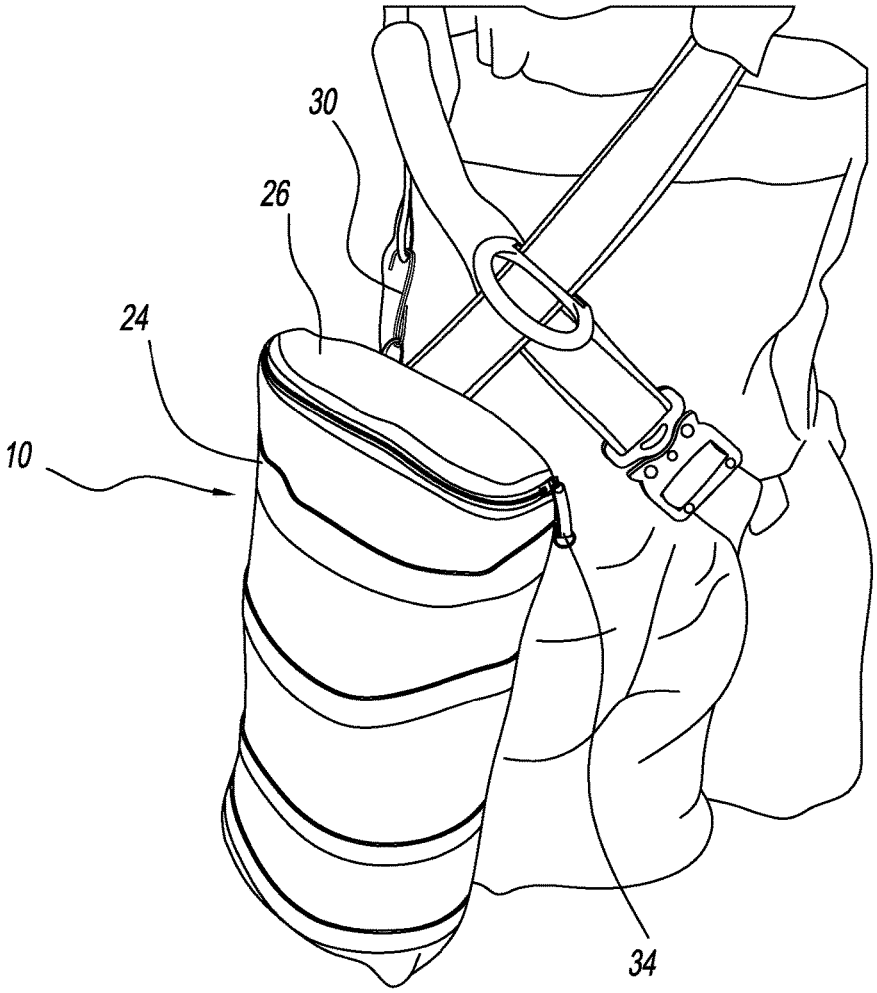
FIG. 6 is a perspective view of a deployment bag in a vertical orientation of an assisted-rescue and personal evacuation system in accordance with the present invention.
Figure 7:
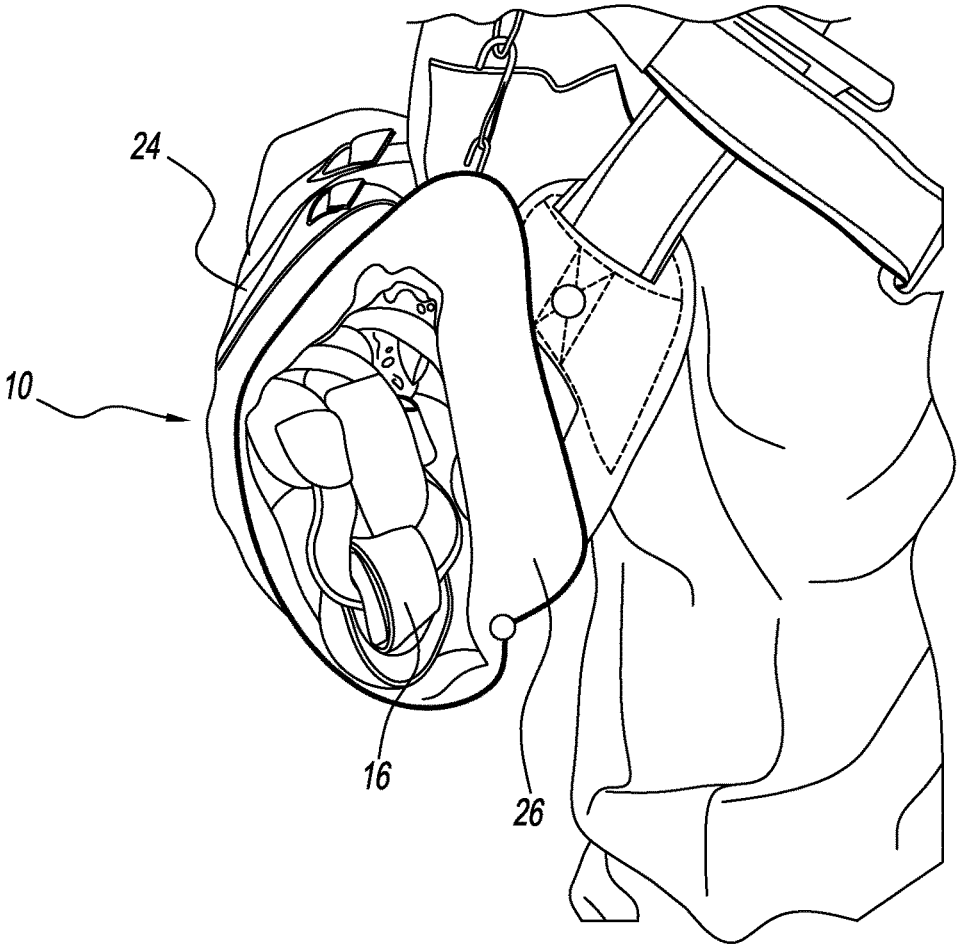
FIG. 7 is a perspective view of an end flap unzipped to reveal the components inside a deployment bag of an assisted-rescue and personal evacuation system in accordance with the present invention.
Figure 10:
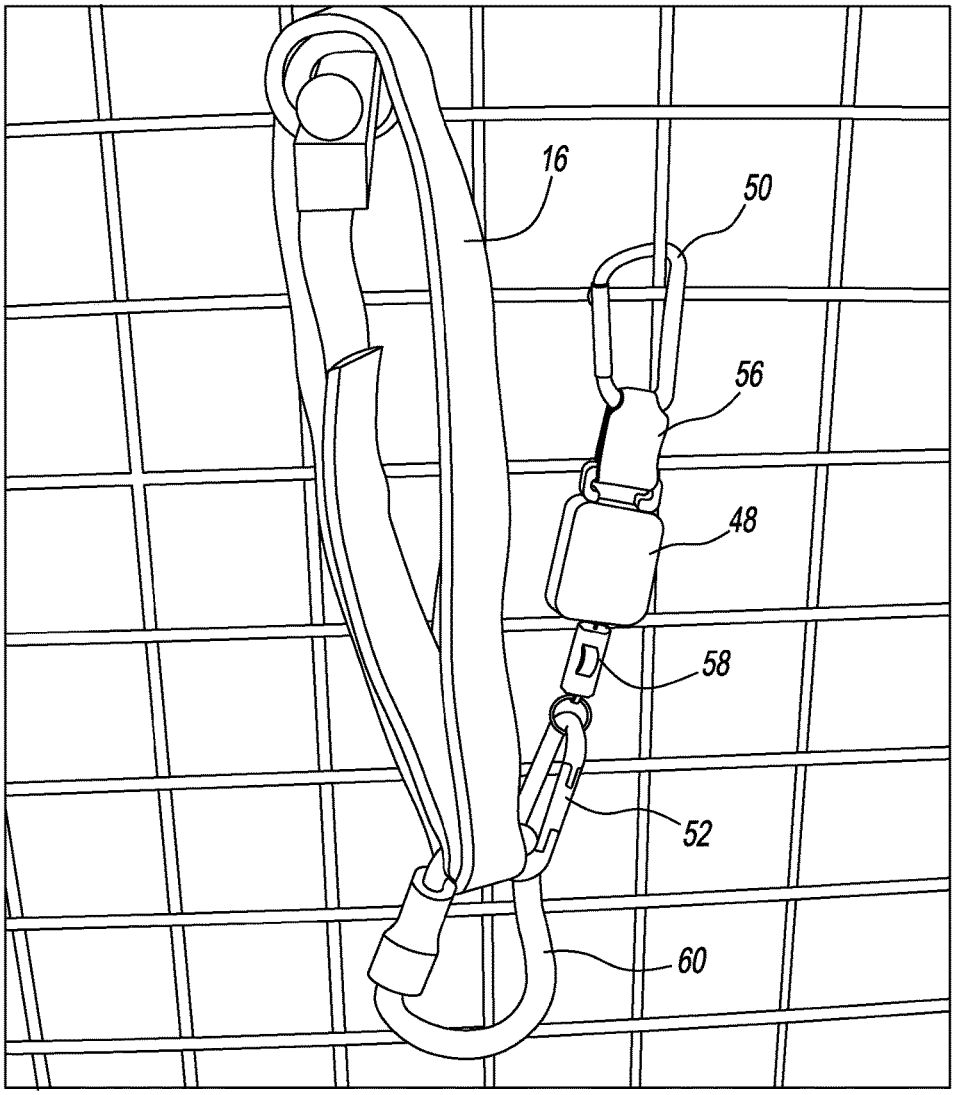
FIG. 10 is a perspective view of a second stop carabiner clipped to an anchor carabiner of an assisted-rescue and personal evacuation system in accordance with the present invention.
Figure 11:
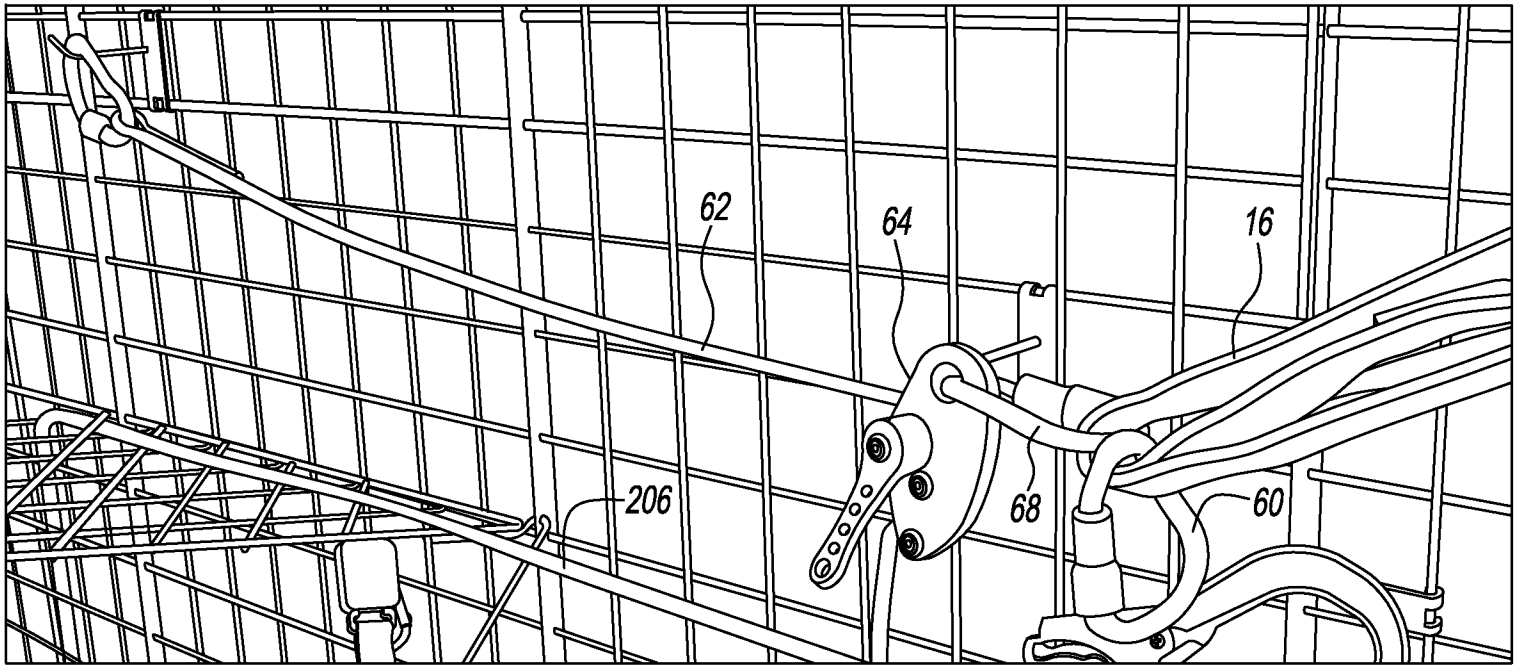
FIG. 11 is a perspective view of a rope carabiner clipped to a flexible anchor strap of an assisted-rescue and personal evacuation system in accordance with the present invention.
Figure 12:
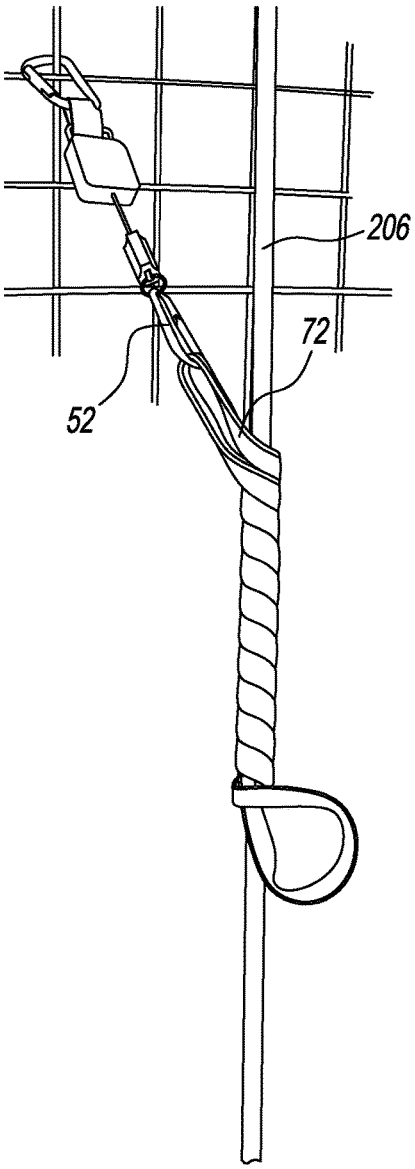
FIG. 12 is a front view of a hitch strap tied to a victim's lanyard and a second stop carabiner clipped to the hitch strap of an assisted-rescue and personal evacuation system in accordance with the present invention.
Figure 13:
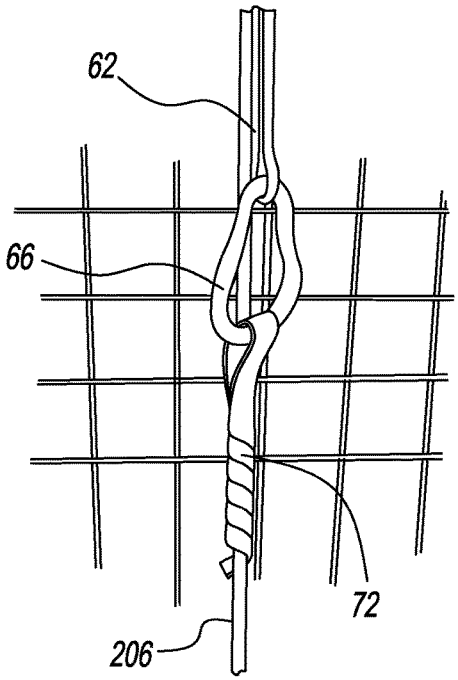
FIG. 13 is a front view of a hitch strap tied to a victim lanyard and a rope carabiner clipped to the hitch strap of an assisted-rescue and personal evacuation system in accordance with the present invention.

The assisted-rescue and personal evacuation system 1 is preferably used in the following manner. With reference to FIGS. 5-6, the deployment bag 10 is secured adjacent a waist of a user in either a horizontal or vertical orientation. With reference to FIG. 8, the deployment bag 10 is unzipped to allow the components in the deployment bag 10 to fall out thereof. All of the components are tethered, such that they do not fall to the ground, when they fall out of the deployment bag 10. With reference to FIG. 9, the first stop carabiner 50 is clipped on to a D-ring 204 of the fall protection full body harness 200. With reference to FIG. 10, the second stop carabiner 52 is removed from the tether loop 46 and clipped on to the anchor carabiner 60. With reference to FIG. 11, the descender carabiner 68 is then clipped on to the flexible anchor strap 16, adjacent the anchor carbineer 60. The rope carabiner 66 is removed from the tether loop 46 and clipped on to a victim's lifting ring or a fall arrest lanyard 206. With reference to FIG. 12, the second stop carabiner 52 is removed from the anchor carabiner 68 and attached to the hitch strap 72. The hitch carabiner 76 is then removed from the hitch strap 72. The hitch strap 72 is tied around the victim lanyard 206 to form a hitch. With reference to FIG. 13, the rope carabiner 66 is attached to the hitch strap 72 and the second stop carabiner 52 is removed from the hitch strap 72.

Figure 15:
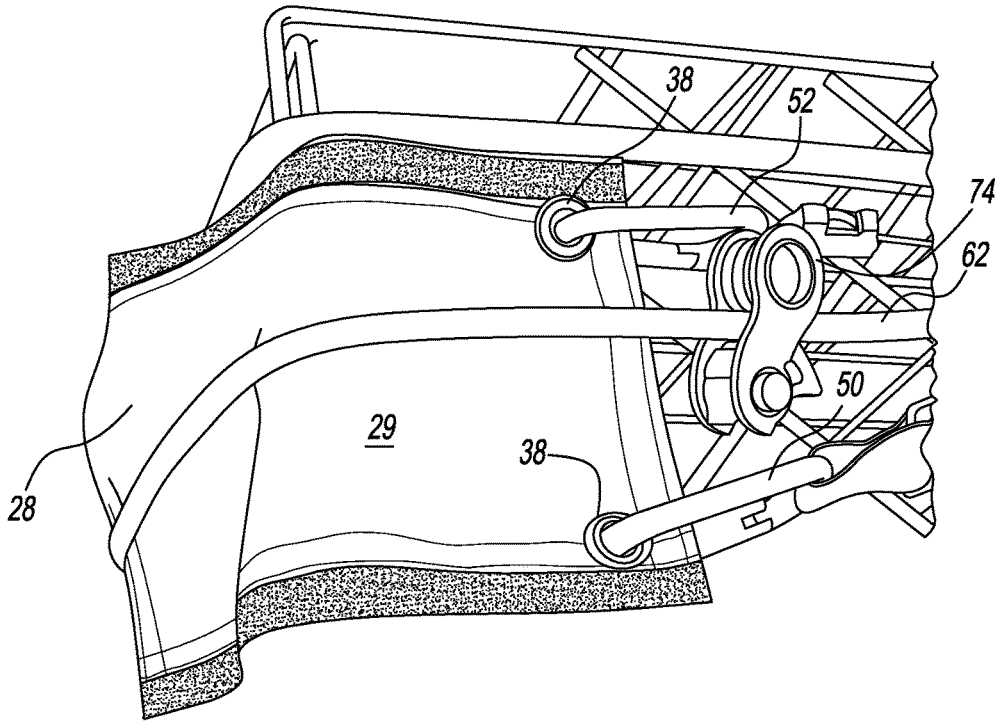
FIG. 15 is a perspective view of a rope protector laid over an edge and a rescue rope located in a middle of the rope protector of an assisted-rescue and personal evacuation system in accordance with the present invention.

With reference to FIG. 14, the second stop carabiner 52 is clipped on to the grabber tether loop 78 extending from the micro rope grab 74. The hitch carabiner 76 is removed from the micro rope grab 74 and retained on the tether loop 46. With reference to FIG. 15, the micro rope grab 74 is attached to the rescue rope 62. The second stop carabiner 52 is removed from the micro rope grab 74 and attached to one of the grommets 38 on the rope protector 28. The rope protector 28 is placed over a structural edge that the rescue rope 62 will engage. The rope protector 28 prevents damage to the rescue rope 62 from the structural edge. A rope engagement surface 29 of the rope protector 28 is coated with a low friction material, such as Teflon. The first stop carabiner 50 is removed from the tether loop 46 and the retractable line 54 of the stop body 48 is wrapped around a structural anchor and attached to the second grommet 38 on the rope protector 28.

Figure 16:
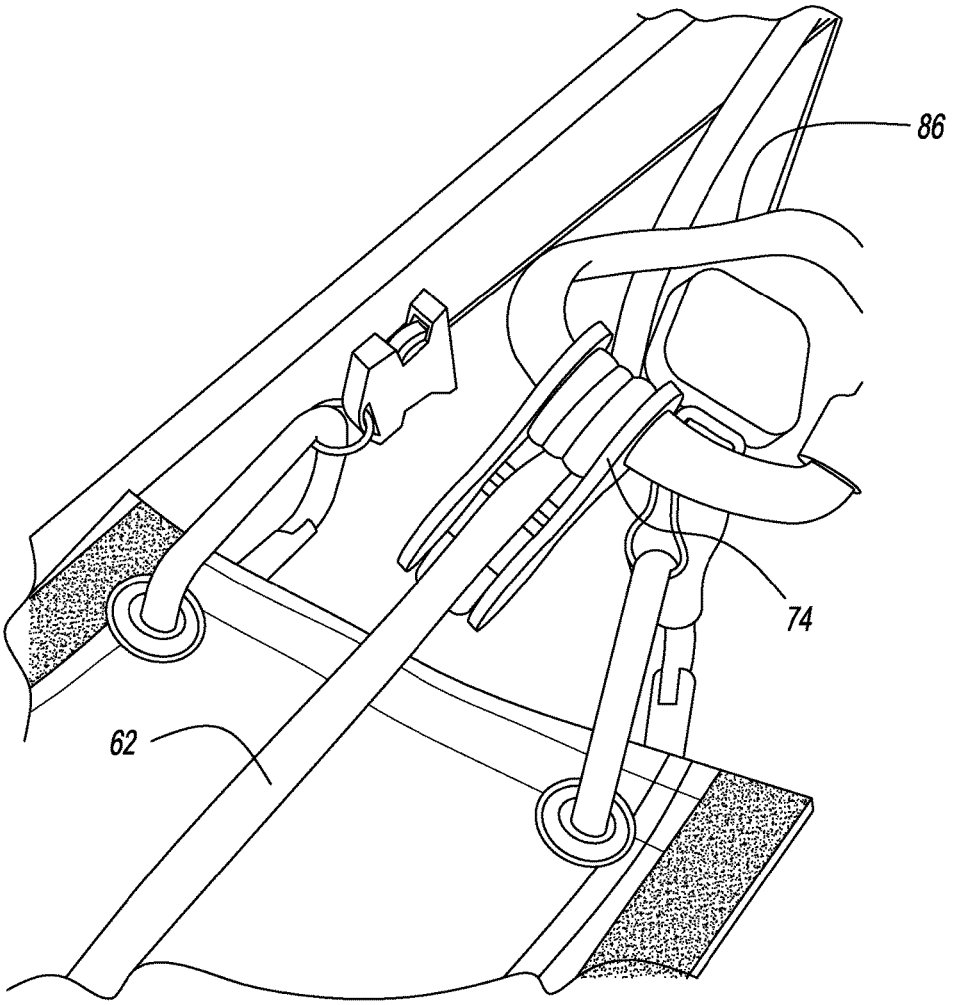
FIG. 16 is a perspective view of a lower haul carabiner clipped into a bore in the micro rope grab of an assisted-rescue and personal evacuation system in accordance with the present invention.
Figure 18:
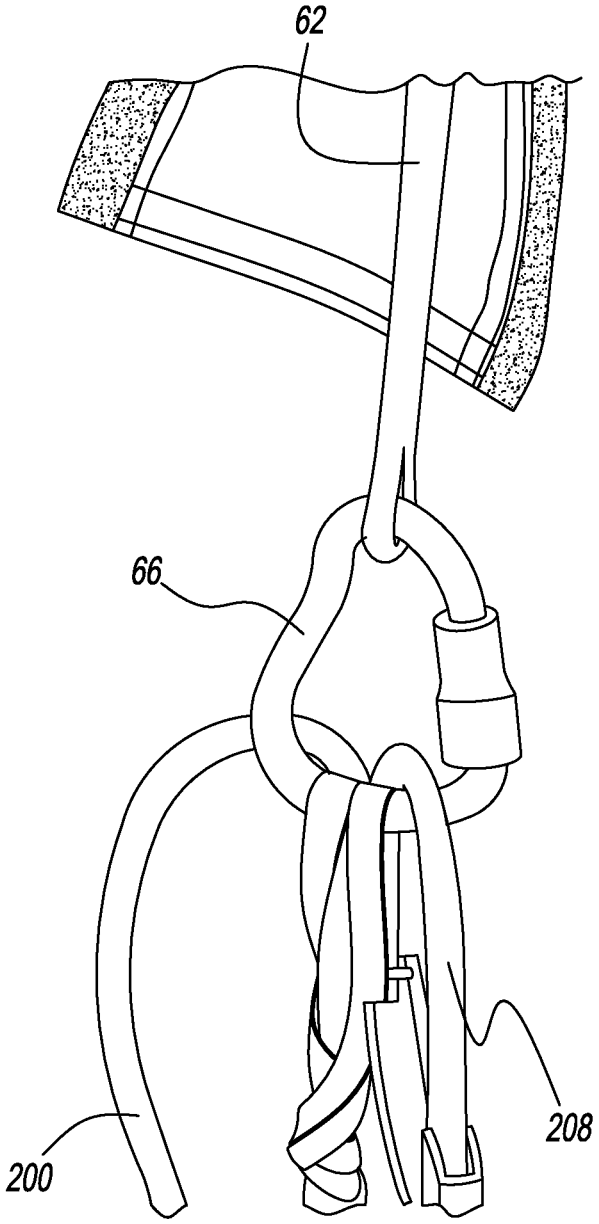
FIG. 18 is a perspective view of a snap hook of a victim's lanyard clipped on to a rope carabiner of an assisted-rescue and personal evacuation system in accordance with the present invention.
Figure 19:
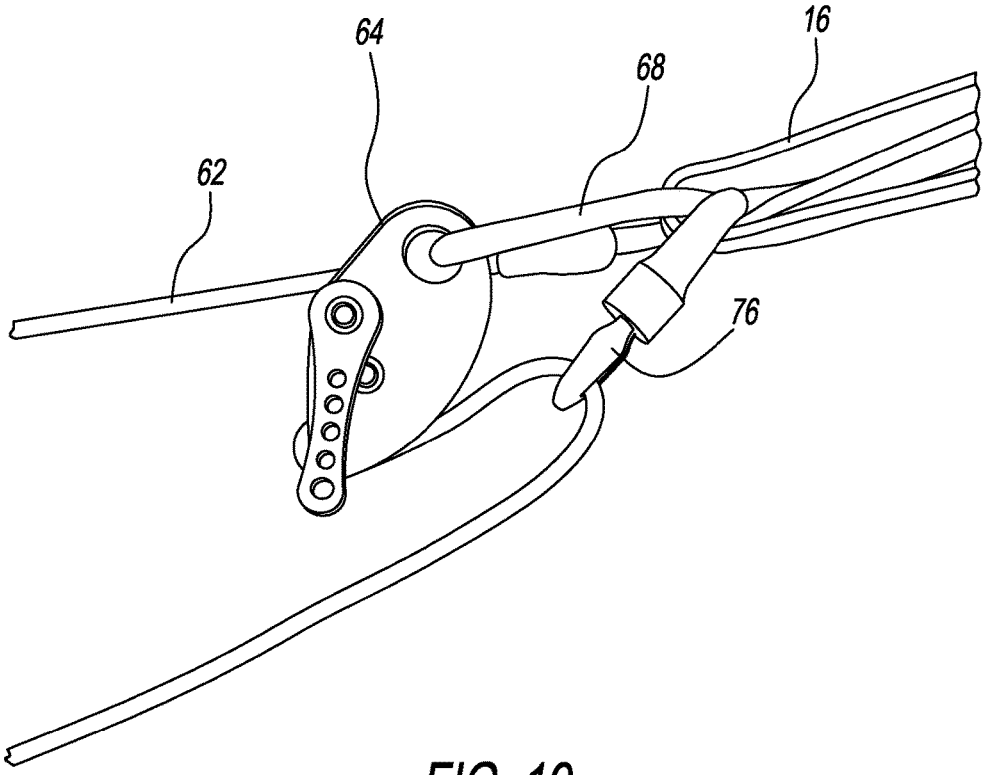
FIG. 19 is a side view of a hitch carabiner clipped around the rescue rope and the flexible anchor strap of an assisted-rescue and personal evacuation system in accordance with the present invention.
Figure 20:
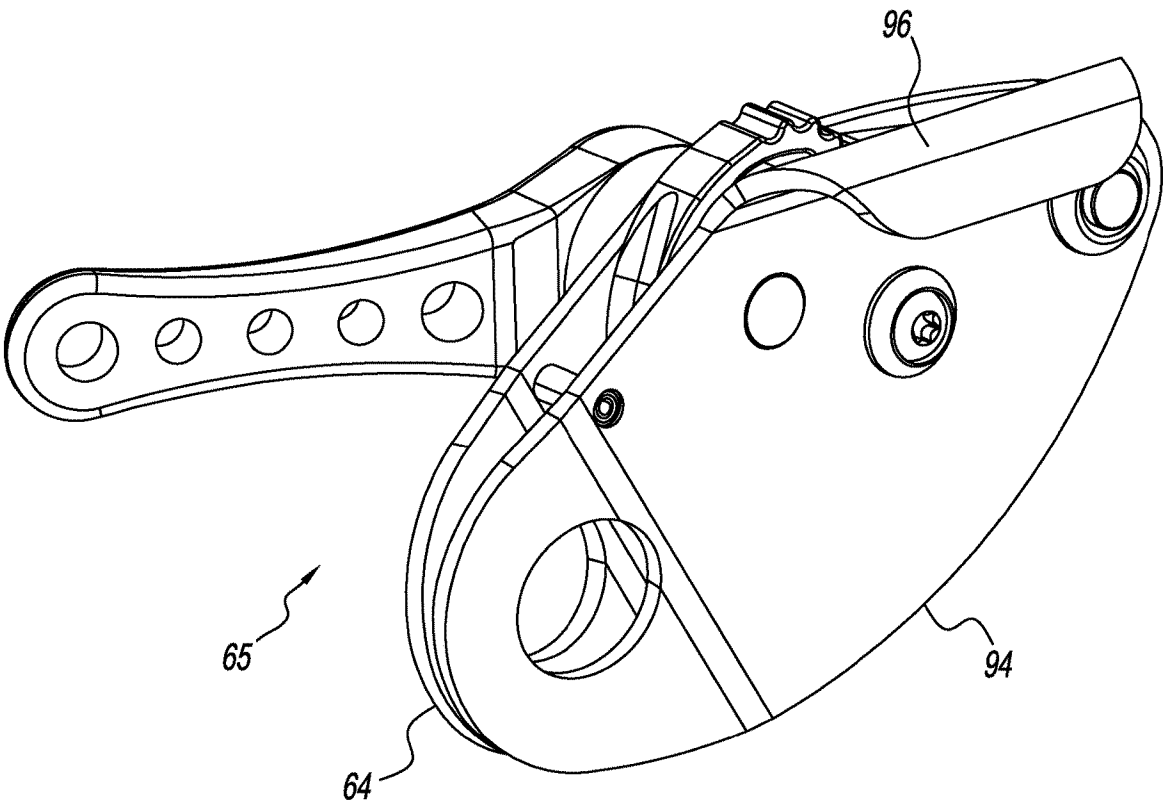
FIG. 20 is a perspective view of a improved descender unit of an assisted-rescue and personal evacuation system in accordance with the present invention.

The micro haul device 80 is preferably deployed in the following manner. With reference to FIG. 16, the lower haul carabiner 86 is clipped into a bore 75 in the micro rope grab 74. With reference to FIG. 17, the upper haul carabiner 84 is removed from the tether loop 46 and clipped on to the anchor carabiner 60. The victim may now be raised with the micro haul device 80, by pulling the power rope 92. The micro haul device 80 provides a 6:1 mechanical advantage for self or assisted rescue. Slack in the rescue rope 62 should be taken-up with the descender unit 64. The victim's lanyard 206 includes a snap hook 208. With reference to FIG. 18, the snap hook 208 is disconnected from a structural support and clipped on to the rope carabiner 66. The micro rope grab 74 is now removed from the rescue rope 62. The upper haul carabiner 84 is removed from the flexible anchor strap 16 and clipped back on to the tether loop 46. The lower haul carabiner 86 is then removed from the bore in the micro rope grab 74. With reference to FIG. 19, the hitch carabiner 76 may be used to add another degree of radius, thus increasing the rescuer's control during the lowering operation. The hitch carabiner 76 is removed from the tether loop 46 and clipped around the rescue rope 62 and the flexible anchor strap 16, adjacent the descender carablineer 68. The victim may now be lowered to the ground utilizing the descender unit 64. The descender unit 64 includes two side plates. An improved descender unit 65 includes a descender unit 64 and an extended side plate 94. One of the two side plates is terminated with a rolled-over edge 96 to form the extended side plate 94. The rolled-over edge 96 prevents damage to the rescue rope 62, if it should become misaligned with the descender unit 64. The rolled-over edge 96 preferably has a curved shape.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An assisted-rescue and personal evacuation system comprising:

a deployment bag having a bag cavity;

a rescue rope is contained within said bag cavity;

an equipment tether includes a tether loop, said tether loop extends from said deployment bag; and a plurality of rescue components includes a flexible anchor strap and a stop tether, said flexible anchor strap is removably retained on said tether loop, said stop tether includes a retracting line and a snap clip, said stop tether is retained on said tether loop, one end of said retracting line is retained by said stop tether, said snap clip terminates the other end of said retracting line, wherein said snap clip is clipped around one of said plurality of components before one of said plurality of components is removed from said tether loop;

a snap hook extends from each end of said deployment bag; and a pair of harness tubes, each one of said pair of harness tubes includes a D-ring, each one of said pair of harness tubes is sized to receive a harness strap of a fall protection full body harness, each said snap hook is secured to one of said D-rings.

2. The assisted-rescue and personal evacuation system of claim 1, further comprising:

a tether strap having a first strap end and a second strap end, said first strap end extends from said deployment bag, said tether loop extends from second strap end.

3. The assisted-rescue and personal evacuation system of claim 1, further comprising:

a flexible anchor strap includes an anchor carabiner, said anchor carabiner is engaged with said tether loop and said flexible anchor strap.

4. The assisted-rescue and personal evacuation system of claim 1, further comprising:

a hitch strap is tied around said rescue rope.

5. The assisted-rescue and personal evacuation system of claim 1, further comprising:

a descender unit is engaged with said rescue rope, said descender unit is used to lower a victim.

6. The assisted-rescue and personal evacuation system of claim 1, further comprising:

a micro hauler unit includes a pulley system with a mechanical advantage, an upper haul carabiner and a lower haul carabiner, said pulley system is used to pull a victim upward.

7. An assisted-rescue and personal evacuation system comprising:

a deployment bag having a bag portion, an end flap and a flap ring, said bag portion includes a bag cavity, said flap ring is secured to an opening of said bag cavity, said flap ring is fabricated from a material with memory, said end flap is secured to said flap ring, wherein when said end flap is unzipped, said flap ring returns to its original position and said end flap is forced against an outer perimeter of said bag portion;

a rescue rope is contained within said bag cavity;

an equipment tether includes a tether loop, said tether loop extends from said deployment bag; and a plurality of rescue components are retained on said tether loop;

a snap hook extends from each end of said deployment bag; and a pair of harness tubes, each one of said pair of harness tubes includes a D-ring, each one of said pair of harness tubes is sized to receive a harness strap of a fall protection full body harness, said snap hook is secured to said D-ring.

8. The assisted-rescue and personal evacuation system of claim 7, further comprising:

a tether strap having a first strap end and a second strap end, said first strap end extends from said deployment bag, said tether loop extends from second strap end.

9. The assisted-rescue and personal evacuation system of claim 7, further comprising:

a flexible anchor strap includes an anchor carabiner, said anchor carabiner is engaged with said tether loop and said flexible anchor strap.

10. The assisted-rescue and personal evacuation system of claim 7, further comprising:

a hitch strap is tied around said rescue rope.

11. The assisted-rescue and personal evacuation system of claim 7, further comprising:

a descender unit is engaged with said rescue rope, said descender unit is used to lower a victim.

12. The assisted-rescue and personal evacuation system of claim 7, further comprising:

a micro hauler unit includes a pulley system, an upper haul carabiner and a lower haul carabiner, said pulley system is used to pull a victim upward.

13. An assisted-rescue and personal evacuation system comprising:

a deployment bag having a bag cavity;

a rescue rope is contained within said bag cavity;

a rope protector is removably attached to an outside surface of said deployment bag, said rope protector includes a rope engagement surface, said rope engagement surface is coated with a low friction material, wherein said rope protector is retained over a structural edge that said rescue rope will engage;

an equipment tether includes a tether loop, said tether loop extends from said deployment bag; and a plurality of rescue components are removably retained on said tether loop;

a snap hook extends from each end of said deployment bag; and a pair of harness tubes, each one of said pair of harness tubes includes a D-ring, each one of said pair of harness tubes is sized to receive a harness strap of a fall protection full body harness, said snap hook is secured to said D-ring.

14. The assisted-rescue and personal evacuation system of claim 13, further comprising:

a flexible anchor strap includes an anchor carabiner, said anchor carabiner is engaged with said tether loop and said flexible anchor strap.

15. The assisted-rescue and personal evacuation system of claim 13, further comprising:

a hitch strap is tied around said rescue rope.

16. The assisted-rescue and personal evacuation system of claim 13, further comprising:

a descender unit is engaged with said rescue rope, said descender unit is used to lower a victim.

17. The assisted-rescue and personal evacuation system of claim 16 wherein:

said descender unit includes two side plates, one of said two side plates is terminated with a rolled-over edge.

* * * * *